US005574263A

United States Patent [19]

Roesner

[11] Patent Number: 5,574,263

[45] Date of Patent: Nov. 12, 1996

[54] PRODUCTION LOGGING MECHANISM FOR ACROSS-THE-BOREHOLE MEASUREMENT

[75] Inventor: Raymond E. Roesner, deceased, late of The Woodlands, Tex., by Cecilia Roesner, executrix

[73] Assignee: Western Atlas International, Inc., Houston, Tex.

[21] Appl. No.: 583,760

[22] Filed: Jan. 11, 1996

Related U.S. Application Data

[63] Continuation of Ser. No. 323,357, Oct. 14, 1994, abandoned.

[51] Int. Cl.[6] ..... G01V 1/40

[52] U.S. Cl. ..... 181/102; 367/25; 166/250.11

[58] Field of Search ..... 367/25, 86, 911; 181/102; 166/250, 264; 73/155

[56] References Cited

U.S. PATENT DOCUMENTS 4,435,978 3/1984 Glatz ..... 73/155
4,974,446 12/1990 Vigneaux ..... 73/155
5,251,479 10/1993 Siegfried, II et al. ..... 73/155

*Primary Examiner*—Ian J. Lobo
*Attorney, Agent, or Firm*—James L. Jackson; Darryl M. Springs

[57] ABSTRACT

A production logging tool for use in deviated wellbores is provided having an elongate tool body and an elongate sensor probe that is capable of lateral movement relative to the tool body. The sensor probe is connected to the tool body by a mechanism serving to deploy the sensor probe such that it is oriented across the wellbore. The tool body has a defined weight and the probe has a weight less than the defined weight, thus causing gravity induced orientation of the sensor probe so as to extend from top to bottom of the fluid passage for sensing all phases of the fluid present therein. The sensor probe is typically of elongate configuration and may support a single elongate sensor or a plurality of independent similar or dissimilar sensors arranged in spaced relation along the length of the probe. Orientation of the sensor probe across the borehole is accomplished mechanically by coil or leaf springs or by a hydraulically or pneumatically powered mechanism or by an electric motor driven mechanism.

19 Claims, 4 Drawing Sheets

PRODUCTION LOGGING MECHANISM FOR ACROSS-THE-BOREHOLE MEASUREMENT

This is a continuation of application Ser. No. 08/323,357 filed Oct. 14, 1994, now abandoned.

FIELD OF THE INVENTION

This invention relates generally to measurement of discrete and average fluid properties of flowing production fluid from wells and more particularly to well production logging instruments having means for measurement across the borehole especially to accommodate the propensity of complex well fluids to become segregated and flow in stratified manner in deviated wells. This invention also relates to mechanisms for positioning the sensors of a production fluid logging tool or logging tool of other character in decentralized close proximity to the wall surface of a well bore or well casing to facilitate efficiency of well logging and to permit efficient running of the tool.

BACKGROUND OF THE INVENTION

As used herein the terms "wellbore", "borehole" and "fluid passage" are intended to encompass any flow passage such as is defined by a drilled bore in an earth formation, a well casing or production conduit that is present within the drilled bore or any other pipe or tubing that defines a flow passage through which fluid, such as well fluid may flow. The term "fluid" as used herein encompasses liquids such as crude oil and water and gases such as natural gas, as well as mixtures of crude oil, water and natural gas.

Due to the plurality of fluids in a producing oil well, flow regimes for the production of petroleum fluids from wells can become extremely complex and segregated. This becomes even more acute in deviated wells for the reason that fluid phases, fluid density and the action of gravity on the well fluid can significantly influence separation of the various phases of the production fluid when the well bore or flow conduit is deviated from the vertical. The lighter density production fluid will rise to the top of the deviated wellbore and pass over the heavier density fluid. Thus, it can be quite difficult to determine the average fluid properties (phase segregation) if conventional, centralized production logging instruments are employed. In wells producing more than one phase, the phases tend to move up the well at different velocities due to the difference in densities between the phases and in some cases one or more of the phases will be moving downwardly while other phases are moving upwardly. It has been firmly established that the light-density phases of the production fluid move up the well faster than do the heavy-density phases. It has been established that the lighter phases also occupy a small cross-sectional area when this phase segregation occurs as a result of wellbore deviation angles.

Through-tubing logging instruments are limited in diameter to the size of the smallest restriction. These small instruments are traditionally run through the wellbore in such manner that the instrument and the sensors of the instrument are centralized within the wellbore, that is they are held by various means in the center of the pipe. With the instrument thus centralized, the measurement is made inside the tool body by sensors located within the instrument housing. Hence, if a centralized instrument is operated in a inclined borehole with multiple phases present, the instrument might not detect the light phase on the top of the borehole, or the heavy phase on the bottom. The phase detection that is accomplished through the use of conventional instruments can be quite inaccurate when deviated wells are logged. The purpose of this invention to measure the fluid parameters at many selected points across the borehole, rather than taking production fluid measurements in the center of the wellbore as is conventionally done. Conventional production logging instruments are normally operated in centralized manner within the borehole or well casing. When segregation in deviated wells occurs the centralized instruments do not read the average fluid composition. Rather, they tend to sense a fluid mixture that has an indicated heavier density and is thus inaccurate due to the fact that the lighter phase fluid migrates to and remains on the upper wall of the deviated wellbore. This holds true for fluid capacitance type instruments designed to determine the fraction of water in the production fluid mixture that is being produced from a well or present within the wellbore.

Another problem with centralized logging techniques utilizing tools with embedded or internal sensors involves the quality of instrument centralization. If the instrument centralizers used in highly deviated wells do not provide sufficient force to properly overcome the weight of the instrument housing and its contents and to centralize the instrument, the instrument will tend to be decentralized by its own weight and will rest on or near the bottom wall surface of the wellbore. This leads to the sensor of the instrument being positioned in the heavy phase side of the deviated wellbore and the measurements taken to be erroneous with the heavy phase being dominant.

The problem lies in the fact that a conventional production logging tool typically measures a local internal fluid sample in deviated wells and does not measure the fluid across the whole cross-section of the wellbore. Light phases that migrate to the top wall of the well are not measured by the internal sensors of the conventional centralized instrument. The advantage of the across-the-borehole type production logging devices according to the present invention is that these instruments, using sensors that are placed in a manner to measure from one side of the borehole to the other, can accomplish a true measurement that is representative of the actual production fluid mixture. This measurement or measurements includes all of the phases that are present in the fluid mixture. It is desirable, therefore that a production logging instrument be provided having sensors which measure a combination of the light phases that are present at the top wall of the deviated wellbore and the heavier phase or phases that are located at or near the bottom wall of the wellbore. These measurements are then true representations of the various phases that might be present in the production fluid; the measurements can be efficiently processed to accurately depict the character of the well fluid flowing or present within the wellbore. Additionally, because the instrument of this invention is run decentralized, the heavier body of the tool will be positioned by the influence of gravity in contact with the bottom wall of the wellbore thus, as a consequence, positioning the lighter weight sensor arm of the tool in contact with the top wall of the wellbore. As wellbore deviation is encountered by the tool, the influence of gravity will cause it to be automatically oriented with the tool body in engagement with the lowermost wall of the wellbore or casing and with the sensor arm in engagement with the uppermost wall. This tool therefore obviates the need for rigid centralization of the tool within the wellbore according to conventional practices and thus overcome the disadvantages associated with conventional centralized production logging instruments.

PRIOR ART

Earlier methods that have been employed as attempted solutions to the problems described above are classified into two general areas: The first attempted solution is the provision of a packer or diverter type production logging instrument. This instrument consists of a packer mechanism or a set of metal petals that is designed to force or divert the total flow of fluid through the body of the instrument to permit the instrument to take accurate readings. These methods overcome the fluid phase segregation problem by forcing all or most the light and heavy phases into the instrument for measurement. This is usually done with the logging instrument stationary within the wellbore by first lowering the instrument to the desired depth within the wellbore or well casing and then locking it in place and inflating the packer or opening the diverter. When this takes place a large pressure drop is created across the restriction of the smaller instrument flow passage which is incurred by forcing the larger borehole flow though the smaller sensing section of the instrument. This restriction, in combination with the restrictions of the location locking mechanisms of the instrument, can significantly retard the flow of production fluid and thus typically limits the use of these instruments to wells having low total flow rates, usually under 2,000 barrels per day. Additionally, the pressure drop caused by restricted flow with the diverter active may not be the same as when the instrument is removed, thus potentially leading to the gathering of erroneous data about the production capability of the well.

Another solution to the above problems has been a method using a combination of centralizers that, upon command, can open or close. These centralizers are then used in the closed condition in deviated wells to allow the instruments to contact or run on the bottom wall of the deviated wellbore. The measurements that are taken with this type of logging instrument in engagement with the bottom wall of the wellbore will be representative of the fluid phase or phases flowing along the bottom wall or in the lower portion of the flow passage, usually the heavier phase. The instrument is then centralized within the wellbore by opening the centralizers and a conventional reading is acquired. In this conventional position within the wellbore the fluid phase or phases that are present in the central portion of the flow passage will be sensed. Finally, one or a combination of these centralizers are closed or opened in an attempt to kick or shift the instrument to an angulated position within the wellbore to sense the fluid phase or phases that are present along the top wall of the deviated borehole. Obviously it is difficult to determine if the instrument has achieved the proper angulated position for sensing the fluid regime in the upper portion of the flow passage. Even if instrument positioning as described above is achieved, this method of production logging does not accomplish simultaneous and continuous sensing of all three areas of interest. These well production logs are run sequentially and therefore the data acquired are of different time frames and are sometimes difficult to correlate with each other in order to compute an average fluid composition.

SUMMARY OF THE INVENTION

It is a feature of this invention to provide a novel mechanism for accomplishing accurate measurement of average fluid properties of segregated or stratified flowing well fluid phases especially in highly deviated wells.

It is another feature of this invention to provide a novel mechanism for well production logging wherein measurement of average fluid properties are taken simultaneously across-the-wellbore such that all phases of the flowing production fluid are efficiently measured for accurate determination of average fluid properties.

It is an even further feature of this invention to provide a novel mechanism for well production logging having the capability of deploying multiple differing sensors across the borehole, such as for sensing temperature, capacitance and other fluid conditions and to process the sensor signals individually or combine the individual measurements to form the appropriate averages.

It is another feature of this invention to provide a novel mechanism for well fluid production logging which, when introduced within the wellbore, automatically establishes logging tool decentralized positioning of an elongate fluid density sensor across a deviated wellbore and generally oriented from top to bottom to provide the capability for simultaneous detection of the heavy phase of the production fluid along the bottom wall of the wellbore and the light phase of the fluid that is present along the top wall of the wellbore.

Briefly, the various features and advantages of the present invention are evident in the provision of an elongate logging tool body having a casing collar locator and having various sensors such as a pressure sensor, gamma ray sensor, density sensor and a telemetry section. The production logging tool body, because of its weight, will be positioned by the influence of gravity to engage or ride on the bottom wall of a deviated wellbore. The logging tool further incorporates an actuator strut mechanism that is movable relative to the tool body and is positioned by a suitable actuator mechanism so that a sensor such as a capacitance probe of the tool or other suitable density measuring device is positioned in inclined relation within the wellbore and extends across the wellbore. A set of springs or other suitable urging means will typically function as the power source of the actuator strut mechanism and provides sufficient force to hold an engagement section or sensor pad of the tool against the wall of the wellbore opposite the wellbore wall engaged by the body of the tool. Typically the actuator strut mechanism will engage the top wall of the wellbore as the result of gravity influences tool orientation. Alternatively, the strut actuator may be spring urged to its closed or retracted position and power operated its open or expanded position so that, in the absence of operating power, it can be automatically retracted to its closed position by the strut spring mechanism. From the standpoint of tool orientation the combination of gravity acting on the heavier tool body and the force of the springs or other urging means will be sufficient to ensure that the sensor pad automatically seeks a position so that it engages the top wall of the deviated wellbore. The capability of the tool to automatically orient an elongate sensor diametrically across the wellbore and to extend from the top wall to the bottom wall provides for the production of better quality information as to the wellbore fluid quantity and composition. There is no more pressure drop across the production logging tool than that of a conventional centralized type tool. When the logging tool is being employed well production parameters are not substantially altered. The logging tool mechanism can be run in the continuous mode; that is it can be lowered into and retrieved from the well while taking readings. It is not necessary for the tool to be stationary while logging measurements are being taken.

The fluid flow logging tool of the present invention is naturally in a de-centralized mode in order to take its readings. This eliminates the use of conventional tool centralizers and thereby minimizes the length of the complete tool package that is to be placed in the well. Also, the capability for use of the logging tool in its de-centralized mode minimizes the potential for gathering erroneous data that might otherwise result if the tool were not centralized. In the case of conventional logging instruments insufficient centralizing force, thus enabling the influence of gravity to cause the sensor packages to ride nearer to the bottom wall of the deviated well bore typically causes the instrument to sense only the heavier phases of the fluid regime. The present invention overcomes this problem.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is an elevational view of a production logging tool which is constructed in accordance with the teachings of the present invention and represents the preferred embodiment.

FIG. 2 is an elevational view of a production logging tool representing an alternative embodiment of this invention and being shown in position within a tubular conduit such as a well casing, well tubing, side pocket mandrel or the like.

FIG. 3 is an elevational view illustrating a yet further embodiment of the present invention and showing the production logging tool in de-centralized position within a tubular conduit such as a well casing positioned in a borehole drilled in an earth formation.

FIG. 4 is a front partial sectional view of a point-to-point profile production fluid logging tool which is shown in its retracted position for passage through a wellbore or conduit.

FIG. 5 is a side elevational view illustrating the logging tool of FIG. 4 and showing both the collapsed running position of the tool and the expanded or extended sensing position of the tool as would occur when the tool is oriented for sensing within a wellbore.

Figure 6:
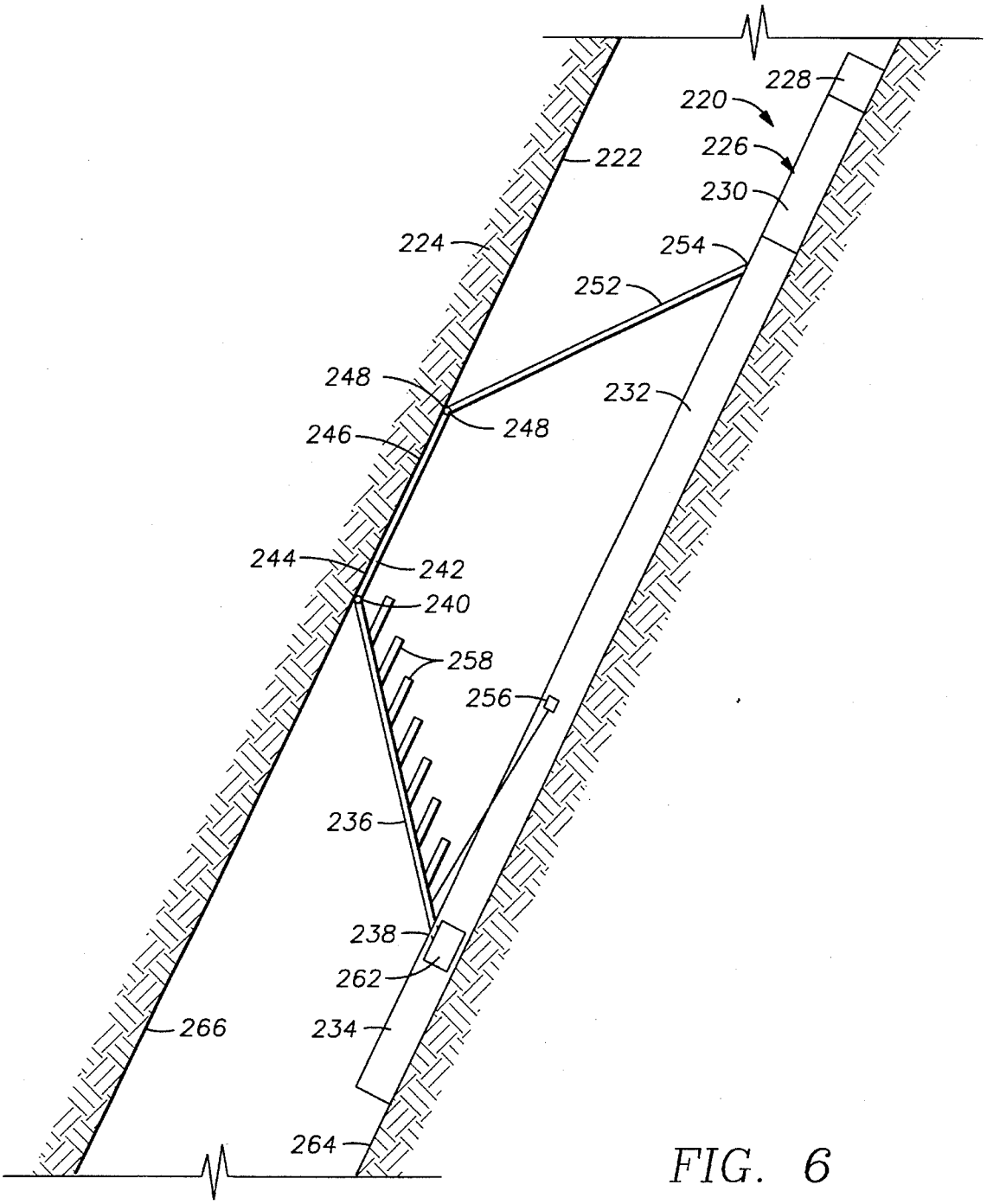

FIG. 6 is a sectional view of a deviated borehole within an earth formation and by way of elevational view showing a swing arm type production logging tool which is constructed in accordance with the present invention being situate with its tool body structure de-centralized and in contact with the bottom wall of the wellbore and its sensor arm positioning a plurality of spaces sensors diametrically across the borehole.

DETAILED DESCRIPTION OF PREFERRED EMBODIMENT

Figure 1:
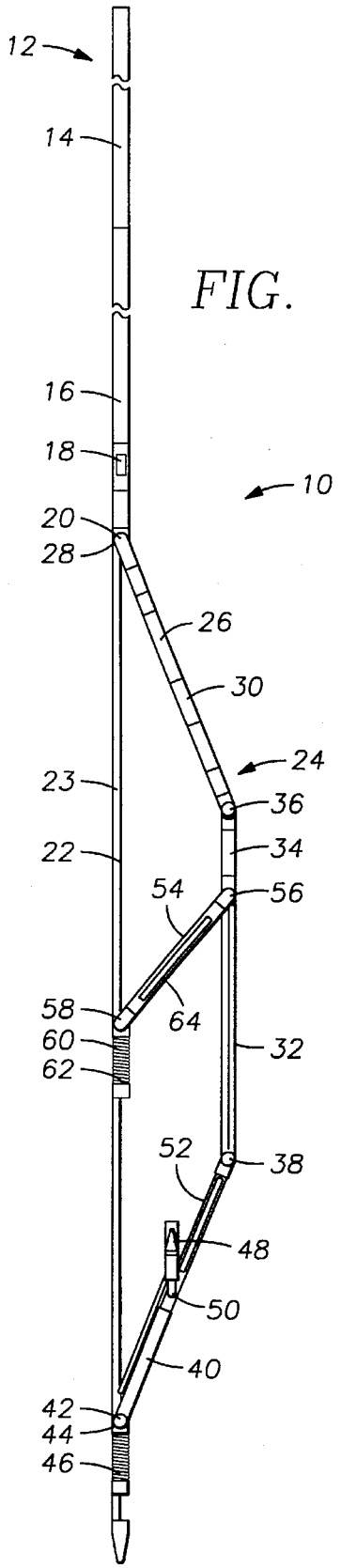

Referring now to the drawings and first to FIG. 1, a production logging tool constructed in accordance with the present invention and representing the preferred embodiment is shown generally at 10 and incorporates an elongate generally cylindrical tool body shown generally at 12 having a casing collar locator, a telemetry and gamma ray section 14 and an electronics package section 16. The tool body also includes a pressure sensor 18 and a density source 20.

A section of the elongate tool body 12 is cut-away as shown at 22 to provide a laterally opening receptacle for receiving a sensor positioning mechanism shown generally at 24 when the logging sensor is fully collapsed so as to define a small cross-sectional dimension for traversing the borehole of a well or conduit to a desired depth and for retrieving the logging tool from the wellbore. The sensor positioning mechanism 24 incorporates any one of a number of suitable actuator means for controllably expanding it to the position shown in FIG. 1 to accomplish de-centralization of the tool body 12 within the passage and to urge the logging sensor mechanism into engagement with the opposite wall of the passage. At its upper end the sensor positioning mechanism 24 includes an elongate sensor positioning member 26 which is connected by pivot 28 to the tool body at the upper end of the relieved or cut-away tool body section 22. The sensor positioning member 26 is adapted to pivot to a position of substantially parallel relation with the tool body section 23 when disposed at its fully collapsed position. As shown in FIG. 1 the sensor positioning member 26 is extended from the sensor receptacle 22 to an angulated relation with the tool body section 23. The sensor positioning member may also provide support for other fluid condition detectors such as a temperature probe 30 for detecting the temperature of the flowing fluid medium at a central location within the flow passage or at a multitude of positions. An elongate wall contact member 32 is connected in pivotal relation with the lower end of the sensor positioning member 26 and is typically intended for orientation in substantially parallel relation with the wall surface of the wellbore or other conduit within which the logging tool is located. This wall contact member 32 may also provide for support of particular well logging instruments such as a density detector 34 which is shown to be connected at the upper end of the member 32. The wall contacting member 32 is also provided with upper and lower guide rollers 36 and 38 which establish rolling contact with the wall surface of the fluid passage and therefore serve to maintain the wall contact member 32 in parallel juxtaposition with the fluid passage wall surface diametrically opposite the line of contact of the tool body 12 with the wall surface of the fluid passage. A lower elongate probe positioning element 40 is pivotally connected at its lower end 42 to a spring urged drive member 44 that is disposed in movable relation with the lower end of the tool body section 23. The drive member 44 is urged in an upward direction by a spring 46 in the form of a coil type compression spring. The spring 46 is preloaded when the sensor positioning mechanism 24 is collapsed to its full extent so that when the sensor positioning mechanism 24 is released from its nested relation with the tool section 23 the spring 46 will urge the lower end of the probe positioning member 40 upwardly thus causing movement of the probe positioning member to an angulated relation with the tool body section 23 as shown in FIG. 1, while at the same time driving the wall contact member 32 outwardly into contact with the wall surface of the fluid passage. As an alternative, to provide for efficient tool retrieval in the absence of operating power, the spring 46 can be arranged to move the drive member 44 to its closed or retracted position. In this case a drive motor such as a hydraulic or pneumatic actuator can be employed to move the sensor mechanism outwardly with its retraction being accomplished by the force of the spring 44.

The elongate probe positioning member 40 also provides support for a fluid flow sensor 48 referred to herein as a "spinner" which is pivotally connected at 50 to the probe positioning member 40. In the collapsed position of the sensor mechanism 24 it is appropriate for the spinner 48 to be pivoted into nesting relation within a spinner receptacle 52 that is defined by the upper portion of the probe positioning member 40. When the sensor positioning mechanism 24 is extended in the manner shown in FIG. 1 the spinner 48 will be automatically pivoted about its pivot 50 from the nesting receptacle 52 to a position being substantially centrally of the flow passage within which the tool is received and thus oriented substantially parallel with the direction of fluid flow through the flow passage.

Intermediate the extremities of the wall contact member 32 an elongate sensor strut 54 has its upper end pivotally connected at 56 while its lower end 58 is disposed in pivotal connection with a spring urged drive member 60 having a spring 62 which may be in a form of a coil type compression spring as shown. The spring 62, like spring 46 is loaded upon movement of the sensor positioning mechanism to the collapsed position thereof. Upon release of the sensor positioning mechanism from its nested relation with the tool body section 22 the spring 62 will move the drive member upwardly thereby also moving the pivotal connection 58 upwardly and urging the sensor strut member 54 to the angulated position shown in FIG. 1.

Upon expansion to the position shown in FIG. 1 the sensor positioning mechanism accomplishes de-centralization of the tool body 12 within the flow passage and also positions various sensor components in desired locations within the fluid passage. The temperature probe 30 and the spinner mechanism 48 are located centrally of the flow passage to thus properly locate them for sensing. A capacitance probe 64 is located by the mechanism so that it extends across the flow passage for sensing of all of the various phases of fluid flow within the flow passage. In the alternative, the sensor support 54 may be provided with a plurality of individual production fluid sensors located in spaced relation along the length thereof so that the sensors are each positioned for sensing a particular portion of the cross-section of the fluid passage so that all phases of the fluid may be sensed.

It is desirable that when used in deviated wellbores the logging tool be capable of becoming oriented so that the tool body 12 is in contact with the bottom wall surface portion of the wellbore or conduit while the wall contact member 32 is in contact with the upper wall thereof. This is accomplished by the influence of gravity acting on the differing weights of the tool body 12 and the sensor positioning mechanism 24. The tool body 12, including its various components, is of significantly greater weight compared to the weight of the sensor positioning mechanism 24. The influence of gravity on the tool body 12 thereby positions the tool body in contact with the lower wall of the inclined or deviated wellbore or conduit. Since the sensor positioning mechanism is specifically oriented relative to the elongate tool body, the influence of gravity therefore also orients the sensor positioning mechanism so that the wall contact member 32 is disposed in contact with the upper wall surface portion of the wellbore or conduit. The spring enhanced sensor positioning mechanism 24 expands the sensor mechanism sufficiently to move it into contact with the wellbore wall and with sufficient force to accomplish decentralization of the logging tool mechanism within the wellbore. Thus the capacitance probe and other sensors that may be supported by the sensor support 54 are oriented across the wellbore so that all of the phases of the production fluid can be sensed.

Figure 2:
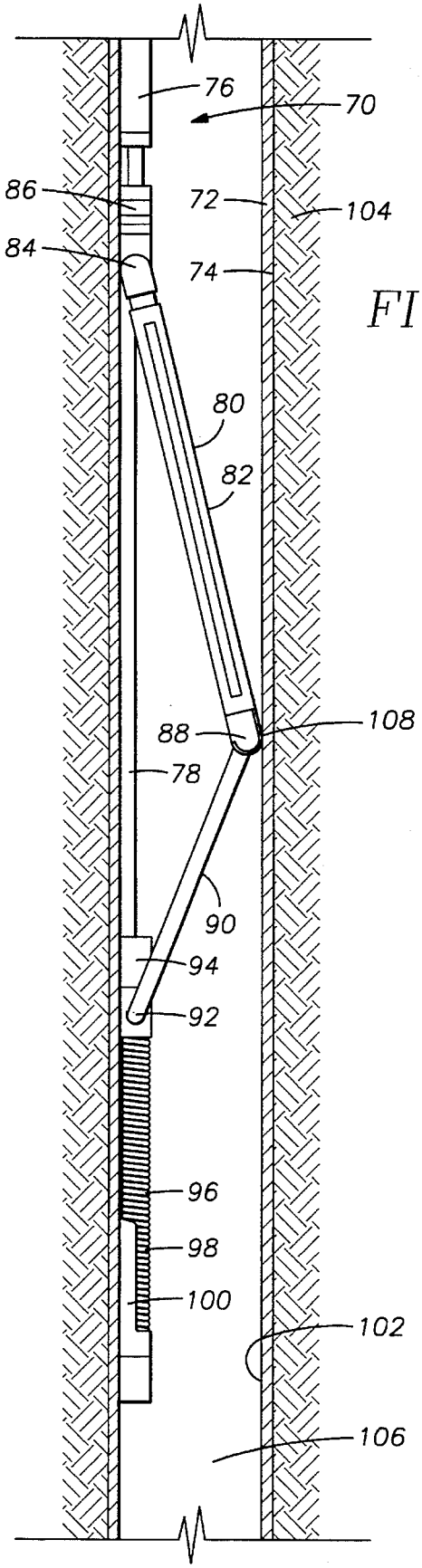

Referring now to FIG. 2 an alternative embodiment of the present invention is illustrated generally at 70 which is shown to be positioned within a well casing 72 extending through a wellbore 74 in an earth formation. The production logging tool 70 incorporates an elongate tool body 76 having a cut-away portion 78 defining a receptacle for a sensor support mechanism shown generally at 81, having a flow housing 80 incorporating an elongate capacitance probe 82. The elongate housing 80 is pivotally connected at its upper end 84 with a connection mechanism 86 which is disposed in fixed relation with the upper portion of the tool body 76. The elongate housing 80 defines a portion of a capacitance probe linkage mechanism and is pivotally connected at its lower end 88 to a sensor support strut 90 which in turn has its lower end 92 connected to a sensor drive element 94 that is disposed in movable relation with the lower portion of the tool body. The sensor drive element 94 is acted upon by a spring 96 which may take the form of a compression type coil spring as shown. The lower end of the spring 96 is interconnected with a spring retainer 98 which is received within the lower end portion 100 of the tool housing structure. The spring 96 supplies sufficient mechanical force against the capacitance probe support 80 to urge one end of the support into engagement with the internal wall surface 102 of the well casing 72 and to force the elongate tool body 76 into engagement with the opposite wall surface 104 as shown in FIG. 2. In this manner, the spring 96 accomplishes decentralization of the tool body 76 within the well bore or conduit defining the flow passage and positions the lower end 88 of the capacitance probe body 80 so that the lower end of the capacitance probe 82 is located in juxtaposition with the casing wall surface 102 and the upper end of the capacitance probe is located in juxtaposition with the diametrically opposite wall of the wellbore. The capacitance probe 82 is therefore located so as to extend across the flow passage defined by the wellbore so that in this inclined position it can sense all phases of the production fluid which are present within the flow passage 106. The sensor mechanism can remain in the position shown in FIG. 2 during running of the tool into the casing 72 to thus permit the capacitance probe to accomplish fluid sensing on a continuous basis as the tool is moved downwardly or upwardly within the flow passage. Interconnection of the sensor housing 80 and the sensor positioning strut 90, essentially at the pivotal lower end connection 88, may be established by a wear plate 108 that resists wear and damage to the sensor mechanism of the tool as it is moved along the inside of the well casing. As an alternative, as mentioned above the spring assembly may be employed to retract or close the sensor mechanism 81 in the absence of power. A powered actuator, operating against the closing force of spring 96, is used to move the sensor mechanism to its open or FIG. 2 position. When opening power is discontinued, the closing spring 96 will retract the capacitance probe within its receptacle 78 for efficiency of running the tool through the wellbore.

Figure 3:
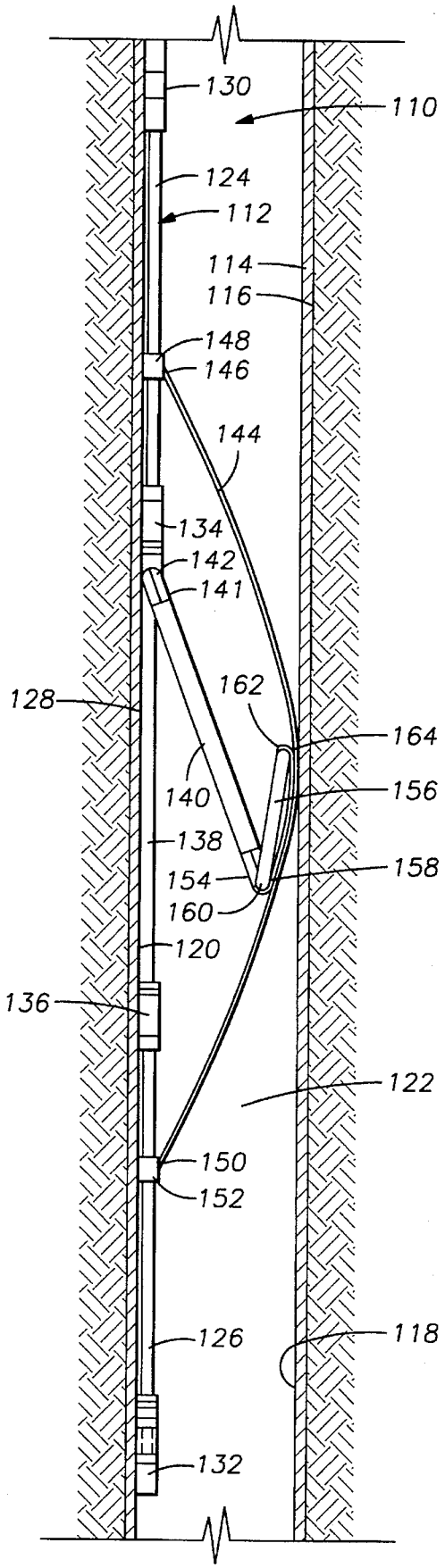

Referring now to FIG. 3, a further alternative embodiment of this invention is shown generally at 110 having an elongate tool body structure 112 which is shown to be positioned within a well casing 114 extending through a wellbore 116 that is drilled within an earth formation. Though shown in FIG. 3 as being vertical, the well casing 114 and the wellbore 116 may be inclined from the vertical or even horizontal, such as in the case of deviated or horizontally drilled wells so that internal casing surface 118 will represent the top wall of the casing while the diametrically opposite well casing surface 120 will be located as the bottom wall. The well casing 114 defines a fluid passage 122 within which the production fluid is either static or moving.

The elongate tool body 112 defines an upper connector section 124, a lower connector section 126 and an intermediate sensor body section 128 the upper and lower connector sections 124 and 126 are provided respectively with connector mechanisms 130 and 132 for connection thereof to other tools and instruments that may be extended into the wellbore in conjunction with the logging process. The connector section 124 is provided with a lower connector 134 having connection with the upper end of the intermediate body section 128. Likewise, the upper end of the lower connector section 126 is provided with an upper connector 136 for connection with the lower end of the intermediate body section 128. The body section 128 is cut-away as shown at 138 to provide an elongate receptacle for receiving an elongate sensor housing 140 that is pivotally connected at its upper end 142 to the connector mechanism 134 and is pivotal from the extended, angulated position shown in FIG. 3 to a position where it is received in nesting relation within the elongate receptacle 138 of the tool body.

When the logging tool 110 is located within the well casing and sensing is desired it is appropriate for the elongate sensor housing 140 to be pivotally moved from the receptacle 138 to a position where the sensor housing extends transversely across the flow passage 122. This feature is accomplished by the provision of a bow spring 144 having its upper end 146 fixed to a movable guide element or slide connector 148 which circumscribes the connector section 124 and is slidable along the length of the connector section to permit expansion and collapsing of the spring 144. Likewise the lower end 150 of the bow spring is disposed in connection with a slide connector 152 which is movably received about the lower connector section 126. The lower end 154 of the elongate sensor housing 140 is disposed in actuating contact with the bow spring as shown to thereby permit extension or collapsing of the housing 140 as the bow spring 144 extends or collapses. If desired, the lower end of the housing 140 may be defined by a guide roller which establishes a movable, guided relation with the bow spring in addition to establishing and actuating engagement with the bow spring. An elongate detector element 156 has its lower end 158 connected to the sensor housing 140 by means of a pivot arrangement 160. Additionally, the upper end 162 of the sensor is provided with a guide member 164 which establishes engagement with the bow spring 144 to ensure positioning of the upper end 162 of the detector in juxtaposition with the wall surface 118 of the well casing. The bow spring 144 is capable of being collapsed by moving its central portion toward the sensor receptacle 138. When this movement occurs, the movable slide connector elements 148 and 152 will move along the length of the respective connector sections 124 and 126 sufficiently to permit the amount of spring collapse that is desired. The bow spring will automatically extend to the position shown in FIG. 3 when it is not otherwise constrained and will have sufficient extension force to induce decentralization of the tool body to maintain the tool body and sensor mechanism in the position shown in FIG. 3. In this position the sensor housing 140 will be inclined so that it is located across the flow passage 122 so that its sensor assembly defines a sensor array across the borehole. The sensor array may be an across-the-borehole capacitance sensor of the nature shown at 64 in FIG. 1 or a plurality of individual sensors, which may be a plurality of like sensors or a sensor array having differing sensors or groups of differing sensors. The sensor or sensor array, regardless of its character, will be adequately positioned across the borehole and typically oriented from bottom to top in relation to the inclined or deviated fluid passage of the wellbore for detection of all phases of fluid within the fluid passage 122. Due to the heavier weight of the tool body relative to the sensor mechanism, the tool body will automatically seek engagement with the bottom wall of the well bore under the influence of gravity and will thus orient the sensor mechanism so that it engages the top wall of the well bore.

Figure 4:
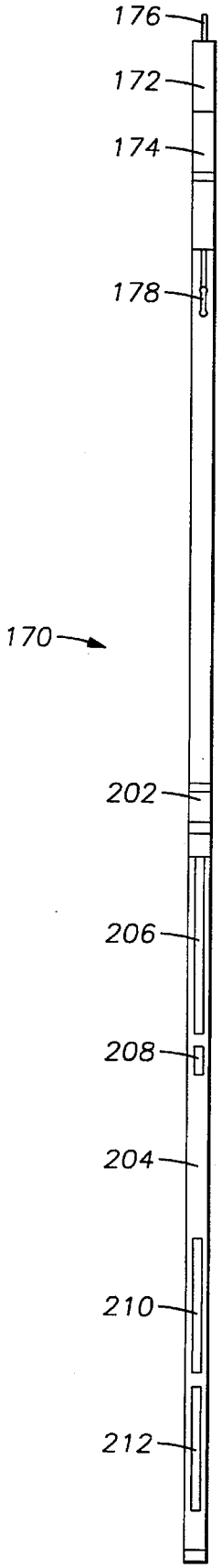
Figure 5:
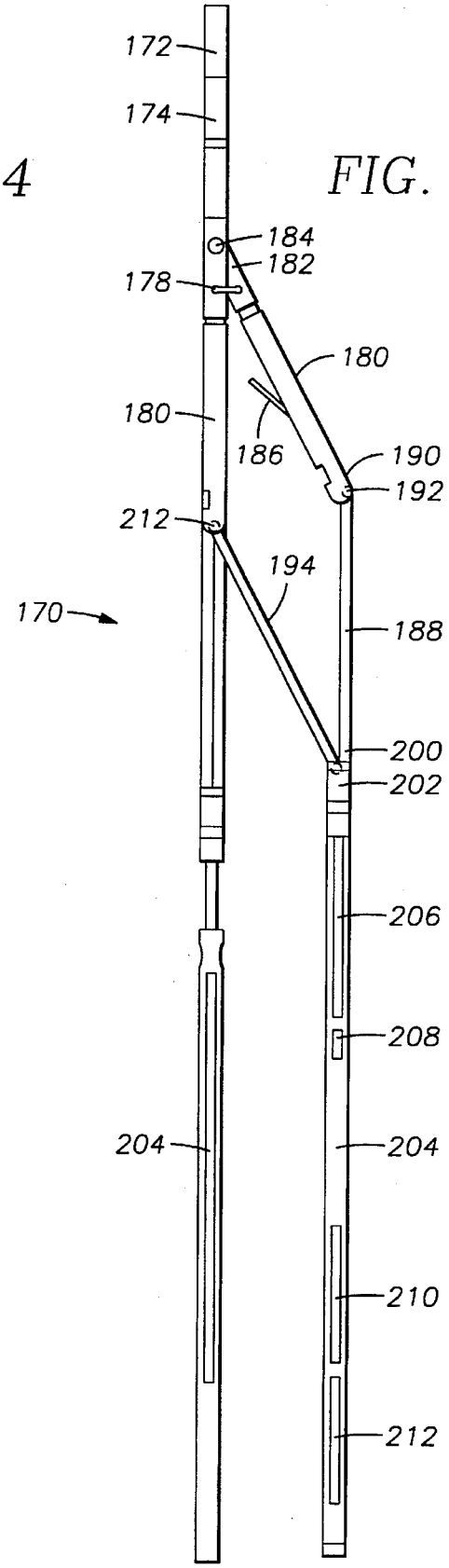

A further alternative embodiment of this invention is shown generally at 170 in FIGS. 4 and 5 with FIG. 4 showing the logging tool in its fully collapsed condition such as for traversing the well casing or wellbore. FIG. 5 illustrates the tool both in its collapsed or running position for movement through the wellbore and in its extended or expanded condition for decentralizing the tool within the wellbore or well casing and for location of the sensors on the high side of an inclined wellbore or well casing such as for positioning of a spinner, gamma ray source, density or gamma ray detector and a capacitance probe in the region of the high side of the flow passage if desired. In vertically oriented wellbores or well casings the logging tool provides for location of the spinner, gamma ray source detector and capacitance probe adjacent the wall surface of the wellbore or well casing. At its upper end the logging tool defines a tool support body 172 is having an internal, linearly movable actuator 174 having its upper end 176 being exposed to receive an upward or downward actuating force. The lower end of the actuator element 174 is provided with an actuator linkage 178 having operative driving relation with an elongate sensor housing 180 having its upper end 182 connected by pivot 184 to the housing structure. The sensor housing may be provided with a temperature sensor 186 which, in the extended condition of the mechanism, is located substantially centrally of the flow passage of the well casing or other flow conduit. The sensor housing 180 is also shown in FIG. 5 in the fully collapsed position thereof. An elongate actuator linkage element 188 is movably assembled to the lower end 190 of the actuator housing by a pivot connection 192. Another actuator link 194 is movably connected to the tool housing by a pivot connection 196 at its upper end. The lower end of the actuator link 194 is secured by pivot connection 198 to the linkage element 188 and is disposed in substantially parallel relation with the elongate sensor housing 180. The linkage element 188 is fixed at its lower end 200 to a connector mechanism 202 of a sensor housing 204. Thus, upon actuation of the mechanism 74–78, the sensor housing 180 is translated outwardly or laterally to the offset position shown in FIG. 5, causing the linkage struts 188 and 194 to maintain the sensor housing 204 in substantially parallel relation with the upper, tool support end 172 of the tool body. When the sensor housing 204 is shifted laterally in this manner it can be positioned in line contact with or in close proximity to the inner wall surface of the well casing or wellbore thereby provided efficiency of signal transmission to and from the formation being logged. The sensor housing 204 is provided with a spinner 206, a gamma ray or other source 208 at its upper end and is provided at its lower end with a gamma ray detector 210 and a capacitance probe 212. Operation of the logging tools of the various embodiments disclosed herein within an inclined or deviated wellbore is depicted in FIG. 6. As shown, the well logging tool is illustrated generally at 220 and is shown to be located within a deviated well bore 222 which is drilled through an earth formation 224. The logging tool 220 with a housing structure shown generally at 226 having an upper connector section 228, an electronics section 230, a transmitter section 232 and a motor and caliber section 234. An elongate sensor element or housing 236 is connected by pivot 238 to the motor and caliper section and is connected at its remote end 240 to a wall engaging pad member 242 having therein a gamma ray detector 244 and a gamma ray receiver 246. The connection 240 is preferably a pivotal connection, thereby permitting the wall contact member 242 to establish efficient surface-to-surface engagement with the wall surface of the well bore. The opposite end 248 of the wall engaging pad 242 is connected by a pivot 250 to a pad positioning strut 252 having its opposite end 254 establishing pivotal connection with the tool body structure. A source 256 is provided for sensing the density of the fluid.

The elongate housing 236 is provided along its length with a plurality of sensors or a sensor array to provide signal output relating to desired parameters of the well being logged. The sensor array may comprise one or more flow rate meters, temperature sensors, capacitance sensors, gamma ray detectors, acoustic impedence meters such as shown collectively at 258 for the purpose of detecting the condition of the various phases of fluid within the flow passage defined by the wellbore. Centrally of the wellbore, the housing structure 236 provides a temperature probe 260 for accomplishing temperature measurement of the fluid centrally of the wellbore. The motor and caliper section 234 accomplishes linear movement of a drive element 262 to which the housing structure 236 is pivotally connected and thereby is operative to cause expansion or contraction of the sensor linkage for the purpose of positioning the pad member 242 into efficient contact with the wellbore or retracting the pad member and the linkages defined by the housing 236 and link 252 into nested relation within a receptacle located in the elongate tool body. Thus, the linkages efficiently movable to the position shown in FIG. 6 with sufficient force to decentralize the elongate tool body with respect to the wellbore. Since the tool body 226 is significantly heavier as compared to the weight of the pad 242 and its linkage system 236 and 252, when disposed within a deviated wellbore the tool body will become oriented by gravity into contact with the lower wall surface 264 of the wellbore while the sensor pad 242 will be oriented for engagement with the diametrically opposite upper wall surface 266 of the wellbore.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A production logging tool for use in a well fluid passage, said well fluid passage defining a wall, comprising:

(a) an elongate tool body adapted for transition through said well fluid passage;

(b) an elongate sensor probe being movably supported by said tool body;

(c) means for positioning said elongate sensor probe across said well fluid passage for detection of all phases of production fluid present therein;

(d) said elongate sensor probe including a sensor pad being disposed for engagement with said wall of said fluid passage;

(e) actuator means connecting said sensor pad in movable engagement with said elongate tool body for urging said sensor pad and said elongate tool body against diametrically opposite sides of said wall;

(f) sensor means being interconnected with said elongate tool body and with said sensor pad and upon movement of said sensor pad into engagement with said wall of said fluid passage, being oriented in diametrical relation across said fluid passage for said sensing of all phases of production fluid within said fluid passage.

2. The production logging tool of claim 1, wherein:

said well fluid passage is deviated from the vertical and defines a top wall, side walls and a bottom wall, said production logging tool further comprising:

means for orienting said elongate tool body to engage said bottom wall of said well fluid passage and orienting said elongate sensor probe to engage said top wall of said well fluid passage.

3. The production logging tool of claim 2, wherein:

said elongate senor probe being substantially located within a vertical plane intersecting said top and bottom walls of said well fluid passage.

4. The production logging tool of claim 1, wherein:

said means for orienting said elongate tool body comprises:

(a) a first weight being defined by said elongate tool body;

(b) a second weight being defined by said elongate sensor probe and being less than said first weight; and (c) said first and second weights being oriented by gravity such that said elongate sensor probe is located uppermost and is oriented across said well fluid passage.

5. The production logging tool of claim 4, wherein:

said sensor means is a single elongate sensor capable of detecting a plurality of fluid phases within the diametrical cross-section of said production fluid passage.

6. The production logging tool of claim 1, wherein:

said sensor means is an elongate sensor support having a plurality of sensors at spaced apart locations along the length thereof and being capable of detecting a plurality of fluid phases within said production fluid passage.

7. The production logging tool of claim 1, wherein said means connecting said sensor pad in movable engagement with said elongate tool body comprises:

(a) a sensor positioning linkage interconnecting said elongate tool body and said sensor pad; and (b) spring means acting between said elongate tool body and said mechanical linkage and urging said sensor positioning linkage in a predetermined direction.

8. The production logging tool of claim 1, wherein said means connecting said sensor pad in movable engagement with said elongate tool body comprises:

spring means acting between said elongate tool body and said sensor pad and urging said sensor pad in a predetermined direction.

9. The production logging tool of claim 8, wherein:

said spring means comprises a bow spring having upper and lower ends thereof interconnected with said elongate tool body and having a central portion thereof disposed in urging relation with said sensor pad.

10. The production logging tool of claim 1, wherein said means selectively moving said sensor pad into engagement with said wall of said fluid passage comprises:

a power energized mechanism interconnecting said elongate tool body and said sensor pad and being operative upon energization for moving said sensor pad into engagement with the wall of said fluid passage with sufficient force to decentralize said elongate tool body within said fluid passage and maintain said elongate tool body in engagement with said wall of said fluid passage.

11. A production logging tool for use in deviated and horizontal wellbores defining a top and a bottom wall, comprising:

(a) an elongate tool body adapted for transition through a wellbore and having a designated weight;

(b) an elongate sensor probe being supported by said tool body;

(c) at least one well fluid sensor being supported by said elongate sensor probe, said sensor probe having a weight less than the designated weight;

(d) means for orienting the fluid sensor probe across sad well fluid passage for detection of all phases of production fluid present therein;

(e) wherein the influence of gravity acting on said production logging tool causes orientation of said production logging tool such that said elongate tool body is in contact with the bottom wall of said wellbore and said sensor probe is in contact with the top wall of said wellbore;

wherein said elongated sensor probe comprises (f) a sensor pad being disposed for engagement with said top wall of said wellbore;

(g) means connecting said sensor pad in movable relation with said elongate tool body;

(h) sensor means being interconnected with said elongate tool body and with said sensor pad upon movement of said sensor pad into engagement with said top wall of said well bore, being oriented across said wellbore for sensing all phases of production fluids therein; and (i) means selectively urging said sensor pad into engagement with said top wall of said well bore.

12. The production logging tool of claim 11, wherein:

said sensor means is a single elongate sensor capable of detecting a plurality of fluid phases within said wellbore.

13. The production logging tool of claim 11, wherein:

said sensor means is an elongate sensor support having a plurality of sensors at spaced apart locations along the length thereof and being capable of detecting a plurality of fluid phases within said wellbore.

14. The production logging tool of claim 11, wherein said means connecting said sensor pad in movable engagement with said elongate tool body comprises:

(a) a mechanical linkage interconnecting said elongate tool body and said sensor pad; and (b) spring means acting between said elongate tool body and said mechanical linkage and urging said mechanical linkage in a direction urging said sensor pad in a selected direction relative to said elongate tool body.

15. The production logging tool of claim 11, wherein said means connecting said sensor pad in movable engagement with said elongate tool body comprises:

spring means acting between said elongate tool body and said sensor pad and urging said sensor pad in a predetermined direction relative to said elongate tool body.

16. The production logging tool of claim 15, wherein:

said decentralizing spring means comprises a decentralizing bow spring having upper and lower ends thereof interconnected with said elongate tool body and having a central portion thereof disposed in urging relation with said sensor pad.

17. The production logging tool of claim 15, wherein said means selectively moving said sensor pad into engagement with said wall of said fluid passage comprises:

a power energized mechanism interconnecting said elongate tool body and said sensor pad and being operative upon energization for moving said sensor pad into engagement with the wall of said fluid passage with sufficient force to decentralize said elongate tool body within said fluid passage and maintain said elongate tool body in engagement with said wall of said fluid passage.

18. A production logging instrument for use within wellbores, comprising:

(a) an instrument support adapted for connection with an elongate logging tool;

(b) first elongate sensor housing being in pivotal connection with said instrument support;

(c) a second elongate sensor housing being in pivotal connection with said first elongate sensor housing and being movable to selected laterally translated position within said wellbore;

(d) an actuator link being pivotally connected to said instrument support and pivotally connected to said second elongate sensor housing and cooperating with said elongate sensor housing to maintain said second elongate sensor housing in substantially parallel relation with said instrument support at all positions of lateral translation thereof; and (e) sensor means being supported by said second elongate sensor housing for conducting logging operations with said wellbores.

19. The production logging instrument of claim 18, further comprising:

sensor means within said first sensor housing being positioned across said wellbore when said second elongate sensor housing is in laterally translated position within said wellbore.

* * * * *